US009191763B2

(12) United States Patent
Breebaart

(10) Patent No.: US 9,191,763 B2
(45) Date of Patent: Nov. 17, 2015

(54) METHOD FOR HEADPHONE REPRODUCTION, A HEADPHONE REPRODUCTION SYSTEM, A COMPUTER PROGRAM PRODUCT

(75) Inventor: Dirk Jeroen Breebaart, Eindhoven (NL)

(73) Assignee: Koninklijke Philips N.V., Eindhoven (NL)

( * ) Notice: Subject to any disclaimer, the term of this patent is extended or adjusted under 35 U.S.C. 154(b) by 641 days.

(21) Appl. No.: 12/680,584

(22) PCT Filed: Oct. 1, 2008

(86) PCT No.: PCT/IB2008/053991

§ 371 (c)(1), (2), (4) Date: Mar. 29, 2010

(87) PCT Pub. No.: WO2009/044347

PCT Pub. Date: Apr. 9, 2009

(65) Prior Publication Data

US 2010/0215199 A1 Aug. 26, 2010

(30) Foreign Application Priority Data

Oct. 3, 2007 (EP) ..... 07117830

(51) Int. Cl.
*H04S 5/00* (2006.01)

(52) U.S. Cl.
CPC ..... *H04S 5/005* (2013.01); *H04S 2400/05* (2013.01)

(58) Field of Classification Search
CPC ..... G06F 3/011; G06F 3/16; H04S 2420/01; H04S 7/302; H04S 7/304; H04S 7/306; H04S 2400/01; H04S 2400/05; H04S 2400/11; H04S 1/005; H04S 3/004; H04S 5/005; H04R 1/10; H04R 5/033; H04M 3/568; G10K 2210/3019
USPC ..... 381/27, 309, 310, 74
See application file for complete search history.

(56) References Cited

U.S. PATENT DOCUMENTS 5,426,702 A 6/1995 Aarts
5,528,694 A 6/1996 Van De Kerkhof et al.

(Continued)

FOREIGN PATENT DOCUMENTS

WO 0209474 A2 1/2002

OTHER PUBLICATIONS

Wightman et al: "Headphone Simulation of Free-Field Listening. i: Stimulus Synthesis" Journal of the Acoustical Society of America, vol. 85, No. 2, Feb. 1, 1989, pp. 858-867.
Pulkki et al: "Localization, Coloration, and Enhancement of Amplitude-Panned Virtual Sources"; AES 16th International Conference, 1999, pp. 257-278.

(Continued)

*Primary Examiner* — Ping Lee

(57) ABSTRACT

A method for headphone reproduction of at least two input channel signals is proposed. Said method comprises for each pair of input channel signals from said at least two input channel signals the following steps. First, a common component, an estimated desired position corresponding to said common component, and two residual components corresponding to two input channel signals in said pair of input channel signals are determined. Said determining is being based on said pair of said input channel signals. Each of said residual components is derived from its corresponding input channel signal by subtracting a contribution of the common component. Said contribution is being related to the estimated desired position of the common component. Second, a main virtual source comprising said common component at the estimated desired position and two further virtual sources each comprising a respective one of said residual components at respective predetermined positions are synthesized.

25 Claims, 9 Drawing Sheets

(56) References Cited

U.S. PATENT DOCUMENTS

| | | | | |
|---|---|---|---|---|
| 6,532,291 | B1 * | 3/2003 | McGrath | 381/74 |
| 8,064,624 | B2 * | 11/2011 | Neugebauer et al. | 381/310 |
| 2002/0031232 | A1 | 3/2002 | Roovers | |
| 2007/0223751 | A1 * | 9/2007 | Dickins et al. | 381/310 |

OTHER PUBLICATIONS

Clark et al: "The 'Stereosonic' Recording and Reproducing System"; Journal of the Audio Engineering Society, Apr. 1958, vol. 6, No. 2, pp. 102-117.

Theile et al: Localization of Lateral Phantom Sources; Journal of the Audio Engineering Society, 1977, vol. 25, pp. 196-200.

Pulkki et al, "Localization, Coloration, and Enhancement of Amplitude-Panned Virtual Sources" AES 16th International Conference, 1999, pp. 257-278.

Clark et al, "The 'Stereosonic' Recording and Reproduction System", Journal of the Audio Engineering Society, vol. 6, No. 2, Apr. 1958, pp. 102-117.

Lipshitz, "Stereo Microphone Techniques . . . Are the Purists Wrong?", J. Audio Eng. Soc., vol. 34, No. 9, Sep. 1986, pp. 716-735.

Theile et al, "Project Notes/Engineering Briefs", J. Audio Engineering Society, vol. 25, pp. 196-200, 1977.

* cited by examiner

Receiving multiple channels of input data C1[n], C2[n],... where n is a channel index. E.g. for 2-channels, receiving l[n], and r[n], where l is left, and r is right.

Decomposing the input data per channel into time/frequency tiles for the input data channels using FFT (fast Fourier transform) and using a windowing function w[n] of length n superimposed on the tiles to obtain a sample data frame m; and optionally using filter banks. E.g. for 2-channels, data frame m may be obtained as follows:

$$l_m[n] = w[n]l[n + mN/2]$$
$$r_m[n] = w[n]r[n + mN/2]$$

Converting the framed data using FFT, into multiple FFT bins in the freq. domain (with index k). E.g. for 2-channels an FFT bin may be obtained as follows:

$$L_m[k] = \sum l_m[n]\exp\left(\frac{-2\pi jnk}{N}\right)$$
$$R_m[k] = \sum r_m[n]\exp\left(\frac{-2\pi jnk}{N}\right)$$

Grouping logically the FFT bins (with index k) into 20-40 parameter bands b for which the number of FFT indices k in an FFT bin is smaller (i.e. lower freq. resolution) for low parameter bands b than for high parameter bands b.

Determining power parameter values. E.g. for 2-channels, a left channel power $P_l[b]$; a right channel power $P_r[b]$; and a cross-power $P_x[b]$; may be determined for a parameter band b as follows:

To Fig. 5B

Fig. 5A

From Fig. 5A $$P_l[b] = \sum_{k=k_b(b)}^{k=k_b(b+1)-1} L_m[k]L_m^*[k]$$

$$P_r[b] = \sum_{k=k_b(b)}^{k=k_b(b+1)-1} R_m[k]R_m^*[k]$$

$$P_x[b] = \sum_{k=k_b(b)}^{k=k_b(b+1)-1} L_m[k]R_m^*[k]$$

Decomposing the time/frequency tiles of the input data using the power parameter values resulting in main common (correlated) component s (representing objects in the audio), and residual component d (representing ambiance of the audio); and determining output data. E.g. for 2-channels the output data may be as follows:

$$L[k] = \cos(\upsilon[b])S[k] + D[k]$$

$$R[k] = \sin(\upsilon[b])S[k] - D[k]$$

Determining angles α and β, e.g. for 2-channels α and β may be determined as follows:

$$\alpha[b] = \frac{1}{2}\arccos\left(\frac{P_x[b]}{\sqrt{P_l[b]P_r[b]}}\right)$$

$$\beta[b] = \tan\left(\arctan(\alpha[b])\frac{\sqrt{P_r[b]} - \sqrt{P_l[b]}}{\sqrt{P_r[b]} + \sqrt{P_l[b]}}\right)$$

To Fig. 5C

Fig. 5B

From Fig. 5B

Estimating a desired (spatial) position angle v of the common component s[k] of the current time/frequency tile between the two loudspeaker positions; where: v=0 represents the position of the left front speaker (-30 degrees); and v=π/2represents the position of the right front speaker (+30 degrees). If head-tracking is provided, modifying the estimated position based on the head-tracking data. E.g. for 2-channels and without head-tracing, position angle v, may be estimated as follows:

$$v[b] = \arctan\left(\frac{\sqrt{P_l[b]}\cos(\alpha[b]+\beta[b])}{\sqrt{P_r[b]}\cos(-\alpha[b]+\beta[b])}\right)$$

Determining a perceived position angle r (Note: here r does not indicate right) by remapping a position angle range v to the perceived position angle range r. E.g. position range v = 0…90 may be remapped to perceived position range r = -30…30, which may be performed using the following:

$$r[b] = \left(-v[b] + \frac{\pi}{4}\right)\frac{2}{3}$$

Modifying the perceived position angle r[b] to provide a modified perceived position angle r'[b], if desired. Using head-tracker control data results as an offset h to the perceived position, if desired and/or using a selected value c to widen the stage, if desired. E.g. the modified position may be determined as follows:

$$r'[b] = r[b] + h \text{, and/or}$$
$$r'[b] = cr[b]$$

To Fig. 5D

Fig. 5C

From Fig. 5C

Determining appropriate HRTFS (head related transfer functions), e.g., with $H_l[k,\xi]$ the FFT index k of an HRTF, for the left ear at spatial position $\xi$. The angle $\nu$ represents the desired spatial position of the ambiance, which may for example, be +90 and -90 degrees, and may be dependent on the head-tracker data as well. With $p_l[b]$ the average magnitude value of the left-ear HRTF in parameter band b, $p_r[b]$ the average magnitude value of the right-ear HRTF in parameter band b, and $\phi[b]$ the average phase difference between $p_l[b]$ and $p_l[b]$ in frequency band b. The HRTFS may be represented in parametric form (i.e., as a constant complex value for each ear within each frequency band b). E.g. for 2-channels, the HRTFS may be determined as follows:

$$H_L[k \in k_b,\xi] = p_l[b,\xi]\exp(-j\phi[b,\xi]/2)$$
$$H_R[k \in k_b,\xi] = p_r[b,\xi]\exp(+j\phi[b,\xi]/2)$$

Resynthesizing the common component d[k] using HRTFS from the estimated (and modified) spatial position. Synthesizing spatially to generate residual data s[k] as a virtual sound source at the desired sound source position r'[b]. The frequency-dependence of r'[b], may be performed for each frequency band b independently. Thus, the output data L'[k], R'[k] for frequency band b may be determined as follows:

$$L'[k] = H_L[k,r'[b]]S[k] + H_L[k,-\gamma]D[k]$$
$$R'[k] = H_R[k,r'[b]]S[k] + H_R[k,+\gamma]D[k]$$

Adding the resynthesized residual data s[k] (at fixed or head-tracking based positions) at their desired spatial locations $\nu$ or r or r' using appropriate HRTFS.

To Fig. 5E

Fig. 5D

METHOD FOR HEADPHONE REPRODUCTION, A HEADPHONE REPRODUCTION SYSTEM, A COMPUTER PROGRAM PRODUCT

FIELD OF THE INVENTION

The invention relates to a method for headphone reproduction of at least two input channel signals. Further the invention relates to a headphone reproduction system for reproduction of at least two input channel signals, and a computer program product for executing the method for headphone reproduction.

BACKGROUND OF THE INVENTION

The most popular loudspeaker reproduction system is based on two-channel stereophony, using two loudspeakers at predetermined positions. If a user is located in a sweet spot, a technique referred to as amplitude panning positions a phantom sound source between the two loudspeakers. The area of feasible phantom source is however quite limited. Basically, phantom source can only be positioned at a line between the two loudspeakers. The angle between the two loudspeakers has an upper limit of about 60 degrees, as indicated in S. P. Lipshitz, "Stereo microphone techniques; are the purists wrong?", J. Audio Eng. Soc., 34:716-744, 1986. Hence the resulting frontal image is limited in terms of width. Furthermore, in order amplitude panning to work correctly, the position of a listener is very restricted. The sweet spot is usually quite small, especially in a left-right direction. As soon as the listener moves outside the sweet spot, panning techniques fail and audio sources are perceived at the position of the closest loudspeaker, see H. A. M. Clark, G. F. Dutton, and P. B. Vanderlyn, "The 'Stereosonic' recording and reproduction system: A two-channel systems for domestic tape records", J. Audio Engineering Society, 6:102-117, 1958. Moreover, the above reproduction systems restrict an orientation of the listener. If due to head or body rotations both speakers are not positioned symmetrically on both sides of a midsaggital plane the perceived position of phantom sources is wrong or becomes ambiguous, see G. Theile and G. Plenge, "Localization of lateral phantom sources", J. Audio Engineering Society, 25:196-200, 1977. Yet another disadvantage of the known loudspeaker reproduction system is that a spectral coloration that is induced by amplitude panning is introduced. Due to different path-length differences to both ears and the resulting comb-filter effects, phantom sources may suffer from pronounced spectral modifications compared to a real sound source at the desired position, as discussed in V. Pulkki and V. Karjalainen, M. and Valimaki, "Coloration, and Enhancement of Amplitude-Panned Virtual Sources", in Proc. 16$^{th}$ AES Conference, 1999. Another disadvantage of amplitude panning is the fact that the sound source localization cues resulting from a phantom sound source are only a crude approximation of the localization cues that would correspond to a sound source at the desired position, especially in the mid and high frequency range.

Compared to loudspeaker playback, stereo audio content reproduced over headphones is perceived inside the head. The absence of an effect of the acoustical path from a certain sound source to the ears causes the spatial image to sound unnatural. The headphone audio reproduction that uses a fixed set of virtual speakers to overcome the absence of the acoustical path suffers from drawbacks that are inherently introduced by a set of fixed loudspeakers as in loudspeaker playback systems discussed above. One of the drawbacks is that localization cues are crude approximation of actual localization cues of a sound source at a desired position, which results in a degraded spatial image. Another drawback is that amplitude panning only works in a left-right direction, and not in any other direction.

SUMMARY OF THE INVENTION

It is an object of the invention to provide an enhanced method for headphone reproduction that alleviates the disadvantages related to fixed set of virtual speakers.

This object is achieved by a method for headphone reproduction of at least two input channel signals, said method comprising for each pair of input channel signals from said at least two input channel signals the following steps. First, a common component, an estimated desired position corresponding to said common component, and two residual components corresponding to two input channel signals in said pair of input channel signals are determined. Said determining is being based on said pair of said input channel signals. Each of said residual components is derived from its corresponding input channel signal by subtracting a contribution of the common component. Said contribution is being related to the estimated desired position of the common component. Second, a main virtual source comprising said common component at the estimated desired position and two further virtual sources each comprising a respective one of said residual components at respective predetermined positions are synthesized.

This means that for e.g. five input channel signals for all possible pair combinations said synthesizing of the common component and the two residual components is performed. For said five input channel signals this results in ten possible pairs of input channel signals. The resulting overall sound scene corresponding to said five input channel signals is then obtained by superposition of all contributions of common and residual components coming from all pairs of input channel signals formed from said five input channel signals.

Using the method proposed by the invention, a phantom source created by two virtual loudspeakers at fixed positions, e.g. at +/−30 degrees azimuth according to a standard stereo loudspeaker set-up, is replaced by virtual source at the desired position. The advantage of the proposed method for a headphone reproduction is that spatial imagery is improved, even if head rotations are incorporated or if front/surround panning is employed. Being more specific, the proposed method provides an immersive experience where the listener is virtually positioned 'in' the auditory scene. Furthermore, it is well known that head-tracking is prerequisite for a compelling 3D audio experience. With the proposed solution, head rotations do not cause virtual speakers to change position thus the spatial imaging remains correct.

In an embodiment, said contribution of the common component to input channel signals of said pair is expressed in terms of a cosine of the estimated desired position for the input channel signal perceived as left and a sine of the estimated desired position for the input channel perceived as right. Based on this the input channel signals pertaining to a pair and being perceived as left and right input channels in said pair are decomposed as:

$$L[k]=\cos(\upsilon)S[k]+D_L[k]$$

$$R[k]=\sin(\upsilon)S[k]-D_R[k]$$

wherein L[k] and R[k] are the perceived as left and perceived as right input channel signals in said pair, respectively, S[k] is the common component for the perceived as left and perceived as right input channel signals, $D_L[k]$ is the residual component corresponding to the perceived as left input channel signal, $D_R[k]$ is the residual component corresponding to the perceived as right input channel signal, and $\upsilon$ is the estimated desired position corresponding to the common component.

Terms "perceived as left" and "perceived as right" are replaced by "left" and "right" throughout the remaining part of the specification for simplicity reasons. It should be noted that the terms "left" and "right" in this context refer to two input channel signals pertaining to a pair from said at least two input channel signals, and are not restricting in any way a number of input channel signals to be reproduced by headphone reproduction method.

The above decomposition provides the common component, which is an estimate of the phantom source as would be obtained with the amplitude panning techniques in a classical loudspeaker system. The cosine and sine factors provide means to describe the contribution of the common component to both signals left and right input channel signals by means of a single angle. Said angle is closely related to the perceived position of the common source. The amplitude panning is in most cases based on a so-called 3 dB rule, which means that whatever the ratio of the common signal in the left and right input channel is, the total power of the common component should remain unchanged. This property is automatically ensured by using cosine and sine terms, as a sum of squares of sine and cosine of the same angle give always 1.

In a further embodiment, the common component and the corresponding residual component are dependent on correlation between input channel signals for which said common component is determined. When estimating the common component, a very important variable in the estimation process is the correlation between the left and right channels. Correlation is directly coupled to the strength (thus power) of the common component. If the correlation is low, the power of the common component is low too. If the correlation is high, the power of the common component, relative to residual components, is high. In other words, correlation is an indicator for the contribution of the common component in the left and right input channel signal pair. If the common component and the residual component have to be estimated, it is advantageous to know whether the common component or the residual component is dominant in an input channel signal.

In a further embodiment, the common component and the corresponding residual component are dependent on power parameters of the corresponding input channel signal. Choosing power as a measure for the estimation process allows a more accurate and reliable estimates of the common component and the residual components. If the power of one of the input channel signals, for example the left input channel signal, is zero, this automatically means that for that signal the residual and common components are zero. This also means that the common component is only present in the other input channel signal, thus the right input channel signal that does have considerable power. Furthermore, for the left residual component and the right residual component being equal in power (e.g. if they are the same signals but with opposite sign), power of the left input channel signal equal to zero means that the power of the left residual component and the right residual component are both zero. This means that the right input channel signal is actually the common component.

In a further embodiment, the estimated desired position corresponding to the common component is dependent on a correlation between input channel signals for which said common component is determined. If the correlation is high, the contribution of the common component is also high. This also means that there is a close relationship between the powers of the left and right input channel signals, and the position of the common component. If, on the other hand, the correlation is low, this means that the common component is relatively weak (i.e. low power). This also means that the powers of the left and right input channel signals is predominantly determined by the power of the residual component, and not by the power of the common component. Hence to estimate the position of the common component, it is advantageous to know whether the common component is dominant or not, and this is reflected by the correlation.

In a further embodiment, the estimated desired position corresponding to the common component is dependent on power parameters of the corresponding input channel signal. For the residual components being zero the relative power of the left and right input channel signals is directly coupled to the angle of the main virtual source corresponding to the common component. Thus, the position of the main virtual source has a strong dependency on the (relative) power in the left and right input channel signal. If on the other hand the common component is very small compared to the residual components, the powers of the left and right input channel signals are dominated by the residual signals, and in that case, it is not very straightforward to estimate the desired position of the common component from the left and right input channel signal.

In a further embodiment, for a pair of input channel signals said power parameters comprise: a left channel power $P_l$, a right channel power $P_r$, and a cross-power $P_x$.

In a further embodiment, the estimated desired position $\upsilon$ corresponding to the common component is derived as:

$$\upsilon = \arctan\left(\frac{\sqrt{P_l}\cos(\alpha+\beta)}{\sqrt{P_r}\cos(-\alpha+\beta)}\right)$$

with $$\alpha = \frac{1}{2}\arccos\left(\frac{P_x}{\sqrt{P_l P_r}}\right)$$

$$\beta = \tan\left(\arctan(\alpha)\frac{\sqrt{P_r}-\sqrt{P_l}}{\sqrt{P_r}+\sqrt{P_l}}\right).$$

It can be shown that this derivation corresponds to maximizing the power of the estimated signal corresponding to the common component. More information on the estimation process of the common component, and the maximization of the power of the common component (which also means minimization of the power of the residual components) is given in Breebaart, J., Faller, C. "Spatial audio processing: MPEG Surround and other applications", Wiley, 2007. Maximizing the power of the estimated signal corresponding to the common component is desired, since for the corresponding signal, accurate localization information is available. In an extreme case, when the common component is zero, the residual components are equal to the original input signals and the processing will have no effect. It is therefore beneficial to maximize the power of the common component, and to minimize the power of the residual components to obtain maximum effect of the described process.

In a further embodiment, the estimated desired position represents a spatial position between the two predetermined positions corresponding to two virtual speaker positions, whereby a range $\upsilon$=0 . . . 90 degrees maps to a range r=−30 . . . 30 degrees for the perceived position angle. The estimated desired position $\upsilon$ as indicated in the previous embodiments varies between 0 and 90 degrees, whereby positions corresponding to 0 and 90 degrees equal to the left and right speaker locations, respectively. For realistic sound reproduction by the headphone reproduction system it is desired to map the above range of the estimated desired position into a range that corresponds to a range that has been actually used for producing audio content. However, precise speaker locations used for producing audio content are not available. Most audio content is produced for playback on a loudspeaker setup as prescribed by an ITU standard (ITU-R Recommend. BS.775-1), namely, with speakers at +30 and −30 degree angles. Therefore, the best estimate of the original position of virtual sources is the perceived place but then under assumption that the audio was reproduced over a loudspeaker system compliant with the ITU standard. The above mapping serves this purpose, i.e. brings the estimated desired position into the ITU-compliant range.

In a further embodiment, the perceived position angle r corresponding to the estimated desired position υ is derived according to:

$$r = \left(-\upsilon + \frac{\pi}{4}\right)\frac{2}{3}.$$

The advantage of this mapping is that is a simple linear mapping from the interval [0 . . . 90] degrees to [−30 . . . 30] degrees. Said mapping to the range of [−30 . . . 30] degrees gives the best estimate of the intended position of a virtual source, given the preferred ITU loudspeaker setup.

In a further embodiment, power parameters are derived from the input channel signal converted to a frequency domain. In many cases, audio content comprises multiple simultaneous sound sources. Said multiple resources correspond to different frequencies. It is therefore advantageous for better sound imaging to handle sound sources in more targeted way, which is only possible in the frequency domain. It is desirable to apply the proposed method to smaller frequency bands in order to even more precisely reproduce the spatial properties of the audio content and thus to improve the overall spatial sound reproduction quality. This works fine as in many cases a single sound source is dominant in a certain frequency band. If one source is dominant in a frequency band, the estimation of the common component and its position closely resemble the dominant signal only and discarding the other signals (said other signals ending up in the residual components). In other frequency bands, other sources with their own corresponding positions are dominant. Hence by processing in various bands, which is possible in the frequency domain, more control over reproduction of sound sources can be achieved.

In a further embodiment, the input channel signal is converted to the frequency domain using Fourier-based transform. This type of transform is well-known and provides low-complexity method to create one or more frequency bands.

In a further embodiment, the input channel signal is converted to the frequency domain using a filter bank. Appropriate filterbank methods are described in Breebaart, J., Faller, C. "Spatial audio processing: MPEG Surround and other applications", Wiley, 2007. These methods offer conversion into sub-band frequency domain.

In a further embodiment, power parameters are derived from the input channel signal represented in a time domain. If the number of sources present in the audio content is low, the computational effort is high when Fourier-based transform or filterbanks are applied. Therefore, deriving power parameters in the time domain saves then the computational effort in comparison with a derivation of power parameters in the frequency domain.

In a further embodiment, the perceived position r corresponding to the estimated desired position is modified to result in one of: narrowing, widening, or rotating of a sound stage. Widening is of particular interest as it overcomes the 60-degree limitation of loudspeaker set-up, due to −30 . . . +30 degree position of loudspeakers. Thus, it helps to create an immersive sound stage that surrounds a listener, rather than to provide the listener with a narrow sound stage limited by a 60-degree aperture angle. Furthermore, the rotation of the sound stage is of interest as it allows the user of the headphone reproduction system to hear the sound sources at fixed (stable and constant) positions independent of a user's head rotation.

In a further embodiment, the perceived position r corresponding to the estimated desired position r is modified to result in the modified perceived position r' expressed as:

$$r' = r + h,$$

whereby h is an offset corresponding to a rotation of the sound stage.

The angular representation of the source position facilitates very easy integration of head movement, in particular an orientation of a listener's head, which is implemented by applying an offset to angles corresponding to the source positions such that sound sources have a stable and constant positions independent of the head orientation. As a result of such offset the following benefits are achieved: more out-of-head sound source localization, improved sound source localization accuracy, reduction in front/back confusions, and a more immersive and natural listening experience.

In a further embodiment, the perceived position corresponding to the estimated desired position is modified to result in the modified perceived position expressed as:

$$r' = cr,$$

whereby c is a scale factor corresponding to a widening or narrowing of the sound stage. Using of scaling is a very simple and yet effective way to widen the sound stage.

In a further embodiment, the perceived position corresponding to the estimated desired position is modified in response to user preferences. It can occur that one user may want a completely immersive experience with the sources positioned around the listener (e.g. a user being a member of the musicians band), while others may want to perceive the sound stage as coming from the front only (e.g. sitting in the audience and listening from a distance).

In a further embodiment, the perceived position corresponding to the estimated desired position is modified in response to a head-tracker data.

In a further embodiment, the input channel signal is decomposed into time/frequency tiles. Using of frequency bands is advantageous as multiple sound sources are handled in more targeted way resulting in a better sound imaging. Additional advantage of time segmentation is that a dominance of sound sources is usually time dependent, e.g. some sources may be quiet for some time. Using time segments, in addition to frequency bands, gives even more control of the individual sources present in the input channel signals.

In a further embodiment, synthesizing of a virtual source is performed using head-related transfer functions (HRTFs). Synthesis using HRTFs is a well-known method to position a source in a virtual space. Parametric approaches to HRTFs may simplify the process even further. Such parametric approaches for HRTF processing are described in Breebaart, J., Faller, C. "Spatial audio processing: MPEG Surround and other applications", Wiley, 2007.

In a further embodiment, synthesis of a virtual source is performed for each frequency band independently. Using of frequency bands is advantageous as multiple sound sources are handled in more targeted way resulting in a better sound imaging. Another advantage of the processing in bands is based on the observation that in many cases (for example when using Fourier-based transforms), the number of audio samples present in a band is smaller than the total number of audio samples in the input channel signals. As each band is processed independently of the other frequency bands, the total required processing power is lower.

The invention further provides system claims as well as a computer program product enabling a programmable device to perform the method according to the invention.

BRIEF DESCRIPTION OF THE DRAWINGS

These and other aspects of the invention will be apparent from and elucidated with reference to the embodiments shown in the drawings, in which:

FIG. 5A-5E illustrates an example flow chart of the method of the invention.

Throughout the figures, same reference numerals indicate similar or corresponding features. Some of the features indicated in the drawings are typically implemented in software, and as such represent software entities, such as software modules or objects.

DETAILED DESCRIPTION OF THE EMBODIMENTS

Figure 1:
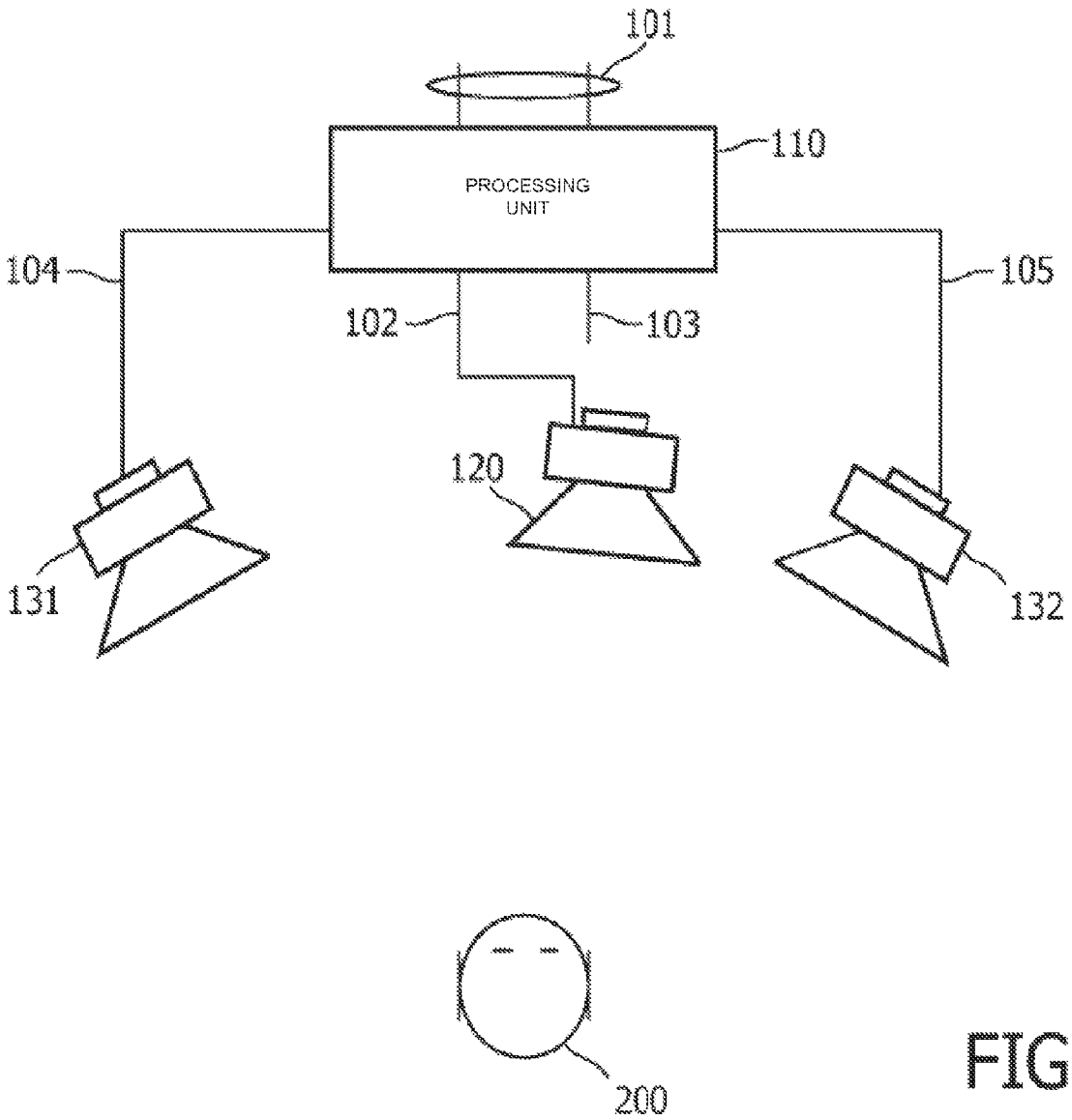
FIG. 1 schematically shows a headphone reproduction of at least two input channel signals, whereby a main virtual source corresponding to a common component is synthesized at an estimated desired position, and further virtual sources corresponding to residual components are synthesized at predetermined positions.

FIG. 1 schematically shows a headphone reproduction of at least two input channel signals 101, whereby a main virtual source 120 corresponding to a common component is synthesized at an estimated desired position, and further virtual sources 131, 132 corresponding to residual components are synthesized at predetermined positions. The user 200 wears headphones which reproduce the sound scene that comprises the main virtual source 120 and further virtual sources 131 and 132.

The proposed method for headphone reproduction of at least two input channel signals 101 comprises the following steps for each pair of input channel signals from said at least two input channel signals. First, a common component, an estimated desired position corresponding to said common component, and two residual components corresponding to two input channel signals in said pair of input channel signals are determined. Said determining is being based on said pair of said input channel signals. Each of said residual components is derived from its corresponding input channel signal by subtracting a contribution of the common component. Said contribution is being related to the estimated desired position of the common component. Second, a main virtual source 120 comprising said common component at the estimated desired position and two further virtual sources 131, and 132 each comprising a respective one of said residual components at respective predetermined positions are synthesized.

Although in FIG. 1 only two input channel signals are shown it should be clear that more input channel signals, for example five, could be reproduced. This means that for said five input channel signals for all possible pair combinations said synthesizing of the common component and the two residual components is performed. For said five input channel signals this results in ten possible pairs of input channel signals. The resulting overall sound scene corresponding to said five input channel signals is then obtained by superposition of all contributions of common and residual components coming from all pairs of input channel signals formed from said five input channel signals.

It should be noted that solid lines 104 and 105 are virtual wires and they indicate that the residual components 131 and 132 are synthesized at the predetermined positions. The same holds for the solid line 102, which indicates that the common component is synthesized at the estimated desired position.

Using the method proposed by the invention, a phantom source created by two virtual loudspeakers at fixed positions, e.g. at +/−30 degrees azimuth according to a standard stereo loudspeaker set-up, is replaced by virtual source 120 at the desired position. The advantage of the proposed method for a headphone reproduction is that spatial imagery is improved, even if head rotations are incorporated or if front/surround panning is employed. Being more specific, the proposed method provides an immersive experience where the listener is virtually positioned 'in' the auditory scene. Furthermore, it is well known that head-tracking is prerequisite for a compelling 3D audio experience. With the proposed solution, head rotations do not cause virtual speakers to change position thus the spatial imaging remains correct.

In an embodiment, contribution of the common component to input channel signals of said pair is expressed in terms of a cosine of the estimated desired position for the input channel signal perceived as left and a sine of the estimated desired position for the input channel perceived as right. Based on this the input channel signals 101 pertaining to a pair and being perceived as left and right input channels in said pair are decomposed as:

$$L[k]=\cos(\upsilon)S[k]+D_L[k]$$

$$R[k]=\sin(\upsilon)S[k]-D_R[k]$$

wherein L[k] and R[k] are the left and right input channel signals 101, respectively, S[k] is the common component for the left and right input channel signals, $D_L[k]$ is the residual component corresponding to the left input channel signal, $D_R[k]$ is the residual component corresponding to the right input channel signal, $\upsilon$ is the estimated desired position corresponding to the common component, and cos(υ) and sin(υ) are the contributions to input channel signals pertaining to said pair.

The above decomposition provides the common component, which is an estimate of the phantom source as would be obtained with the amplitude panning techniques in a classical loudspeaker system. The cosine and sine factors provide means to describe the contribution of the common component to both left and right input channel signals by means of a single angle. Said angle is closely related to the perceived position of the common source. The amplitude panning is in most cases based on a so-called 3 dB rule, which means that whatever the ratio of the common signal in the left and right input channel is, the total power of the common component should remain unchanged. This property is automatically ensured by using cosine and sine terms, as a sum of squares of sine and cosine of the same angle give always 1.

Although, the residual components $D_L[k]$ and $D_R[k]$ are labeled differently as they can have different values, it could be also chosen that said residual components are of the same value. This simplifies calculation, and does improve ambiance associated with these residual components.

For each pair of input channel signals from said at least two input channel signals a common component with the corresponding estimated desired position and residual components are determined. The overall sound scene corresponding to said at least two input channel signals is then obtained by superposition of all contributions of individual common and residual components derived for said pairs of input channel signals.

In an embodiment, the common component and the corresponding residual component are dependent on correlation between input channel signals 101 for which said common component is determined. When estimating the common component, a very important variable in the estimation process is the correlation between the left and right channels. Correlation is directly coupled to the strength (thus power) of the common component. If the correlation is low, the power of the common component is low too. If the correlation is high, the power of the common component, relative to residual components, is high. In other words, correlation is an indicator for the contribution of the common component in the left and right input channel signal pair. If the common component and the residual component have to be estimated, it is advantageous to know whether the common component or the residual component is dominant in an input channel signal.

In an embodiment, the common component and the corresponding residual component are dependent on power parameters of the corresponding input channel signal. Choosing power as a measure for the estimation process allows a more accurate and reliable estimates of the common component and the residual components. If the power of one of the input channel signals, for example the left input channel signal, is zero, this automatically means that for that signal the residual and common components are zero. This also means that the common component is only present in the other input channel signal, thus the right input channel signal that does have considerable power. Furthermore, for the left residual component and the right residual component being equal in power (e.g. if they are the same signals but with opposite sign), power of the left input channel signal equal to zero means that the power of the left residual component and the right residual component are both zero. This means that the right input channel signal is actually the common component.

In an embodiment, the estimated desired position corresponding to the common component is dependent on a correlation between input channel signals for which said common component is determined. If the correlation is high, the contribution of the common component is also high. This also means that there is a close relationship between the powers of the left and right input channel signals, and the position of the common component. If, on the other hand, the correlation is low, this means that the common component is relatively weak (i.e. low power). This also means that the powers of the left and right input channel signals is predominantly determined by the power of the residual component, and not by the power of the common component. Hence to estimate the position of the common component, it is advantageous to know whether the common component is dominant or not, and this is reflected by the correlation.

In an embodiment, the estimated desired position corresponding to the common component is dependent on power parameters of the corresponding input channel signal. For the residual components being zero the relative power of the left and right input channel signals is directly coupled to the angle of the main virtual source corresponding to the common component. Thus, the position of the main virtual source has a strong dependency on the (relative) power in the left and right input channel signal. If on the other hand the common component is very small compared to the residual components, the powers of the left and right input channel signals are dominated by the residual signals, and in that case, it is not very straightforward to estimate the desired position of the common component from the left and right input channel signal.

In an embodiment, for a pair of input channel signals said power parameters comprise: a left channel power $P_l$, a right channel power $P_r$, and a cross-power $P_x$.

In an embodiment, the estimated desired position υ corresponding to the common component is derived as:

$$\upsilon = \arctan\left(\frac{\sqrt{P_l}\cos(\alpha+\beta)}{\sqrt{P_r}\cos(-\alpha+\beta)}\right)$$

with $$\alpha = \frac{1}{2}\arccos\left(\frac{P_x}{\sqrt{P_l P_r}}\right),\ \beta = \tan\left(\arctan(\alpha)\frac{\sqrt{P_r}-\sqrt{P_l}}{\sqrt{P_r}+\sqrt{P_l}}\right).$$

By definition, the normalized cross-correlation ρ is given by:

$$\rho = \frac{P_x}{\sqrt{P_l P_r}},$$

Thus the angle α, and hence the estimated desired position υ are dependent on the cross-correlation ρ.

It can be shown that this derivation corresponds to maximizing the power of the estimated signal corresponding to the common component. More information on the estimation process of the common component, and the maximization of the power of the common component (which also means minimization of the power of the residual components) is given in Breebaart, J., Faller, C. "Spatial audio processing: MPEG Surround and other applications", Wiley, 2007. Maximizing the power of the estimated signal corresponding to the common component is desired, for the corresponding signal, accurate localization information is available. In an extreme case, when the common component is zero, the residual components are equal to the original input signals and the processing will have no effect. It is therefore beneficial to maximize the power of the common component, and to minimize the power of the residual components to obtain maximum effect of the described process. Thus the accurate position is also available for the common component as used in the current invention.

In an embodiment, the estimated desired position represents a spatial position between the two predetermined positions corresponding to two virtual speaker positions, whereby a range $\upsilon$=0 . . . 90 degrees maps to a range r=−30 . . . 30 degrees for the perceived position angle. The estimated desired position $\upsilon$ as indicated in the previous embodiments varies between 0 and 90 degrees, whereby positions corresponding to 0 and 90 degrees equal to the left and right speaker locations, respectively. For realistic sound reproduction by the headphone reproduction system it is desired to map the above range of the estimated desired position into a range that corresponds to a range that has been actually used for producing audio content. However, precise speaker locations used for producing audio content are not available. Most audio content is produced for playback on a loudspeaker setup as prescribed by an ITU standard (ITU-R Recommend. BS.775-1), namely, with speakers at +30 and −30 degree angles. Therefore, the best estimate of the original position of virtual sources is the perceived place but then under assumption that the audio was reproduced over a loudspeaker system compliant with the ITU standard. The above mapping serves this purpose, i.e. brings the estimated desired position into the ITU-compliant range.

In an embodiment, the perceived position angle corresponding to the estimated desired position is derived according to:

$$r = \left(-\upsilon + \frac{\pi}{4}\right)\frac{2}{3}.$$

The advantage of this mapping is that is a simple linear mapping from the interval [0 . . . 90] degrees to [−30 . . . 30] degrees. Said mapping to the range of [−30 . . . 30] degrees gives the best estimate of the intended position of a virtual source, given the preferred ITU loudspeaker setup.

In an embodiment, power parameters are derived from the input channel signal converted to a frequency domain.

A stereo input signal comprises two input channel signals l[n] and r[n] corresponding to the left and right channel, respectively, and n is a sample number in a time domain. To explain how the power parameters are derived from the input channel signals converted to the frequency domain, a decomposition of left and right input channel signals in time/frequency tiles is used. Said decomposition is not mandatory, but it is convenient for explanation purposes. Said decomposition is realized by using windowing and, for example, Fourier-based transform. An example of Fourier-based transform is e.g. FFT. As alternative to Fourier-based transform filterbanks could be used. A window function w[n] of length N is superimposed on the input channel signals in order to obtain one frame m:

$$l_m[n]=w[n]l[n+mN/2]$$

$$r_m[n]=w[n]r[n+mN/2].$$

Subsequently, the framed left and right input channel signals are converted to the frequency domain using FFTs:

$$L_m[k] = \sum l_m[n]\exp\left(\frac{-2\pi jnk}{N}\right)$$

$$R_m[k] = \sum r_m[n]\exp\left(\frac{-2\pi jnk}{N}\right).$$

The resulting FFT bins (with index k) are grouped into parameter bands b. Typically, 20 to 40 parameter bands are formed for which the amount of FFT indices k is smaller for low parameter bands than for high parameter bands (i.e. the frequency resolution decreases with parameter band index b).

Subsequently, the powers $P_l[b]$, $P_r[b]$ and $P_x[b]$ in each parameter band b are calculated as:

$$P_l[b] = \sum_{k=k_b(b)}^{k=k_b(b+1)-1} L_m[k]L_m^*[k],$$

$$P_r[b] = \sum_{k=k_b(b)}^{k=k_b(b+1)-1} R_m[k]R_m^*[k],$$

$$P_x[b] = \mathrm{Re}\left\{\sum_{k=k_b(b)}^{k=k_b(b+1)-1} L_m[k]R_m^*[k]\right\}.$$

Although, the power parameters are derived for each frequency band separately, it is not a limitation. Using only one band (comprising the entire frequency range) means that actually no decomposition in bands is used. Moreover, according to Parseval's theorem, the power and cross-power estimates resulting from a time or frequency-domain representation are identical in that case. Furthermore, fixing the window length to infinity means that actually no time decomposition or segmentation is used.

In many cases, audio content comprises multiple simultaneous sound sources. Said multiple resources correspond to different frequencies. It is therefore advantageous for better sound imaging to handle sound sources in more targeted way, which is only possible in the frequency domain. It is desirable to apply the proposed method to smaller frequency bands in order to even more precisely reproduce the spatial properties of the audio content and thus to improve the overall spatial sound reproduction quality. This works fine as in many cases a single sound source is dominant in a certain frequency band. If one source is dominant in a frequency band, the estimation of the common component and its position closely resemble the dominant signal only and discarding the other signals (said other signals ending up in the residual components). In other frequency bands, other sources with their own corresponding positions are dominant. Hence by processing in various bands, which is possible in the frequency domain, more control over reproduction of sound sources can be achieved.

In an embodiment, the input channel signal is converted to the frequency domain using Fourier-based transform. This type of transform is well-known and provides low-complexity method to create one or more frequency bands.

In an embodiment, the input channel signal is converted to the frequency domain using a filter bank. Appropriate filterbank methods are described in Breebaart, J., Faller, C. "Spatial audio processing: MPEG Surround and other applications", Wiley, 2007. These methods offer conversion into sub-band frequency domain.

In an embodiment, power parameters are derived from the input channel signal represented in a time domain. The powers $P_1$, $P_r$ and $P_x$ for a certain segment of the input signals (n=0 . . . N) are then expressed as:

$$P_l = \sum_{n=0}^{N} L_m[n]L_m^*[n],$$

$$P_r = \sum_{n=0}^{N} R_m[n]R_m^*[n],$$

$$P_x = \mathrm{Re}\left\{\sum_{n=0}^{N} L_m[n]R_m^*[n]\right\}.$$

The advantage of performing power computation in the time domain is that if the number of sources present in the audio content is low, the computational effort in comparison to Fourier-based transform or filterbanks is relatively low. Deriving power parameters in the time domain saves then the computational effort.

In an embodiment, the perceived position r corresponding to the estimated desired position is modified to result in one of: narrowing, widening, or rotating of a sound stage. Widening is of particular interest as it overcomes the 60-degree limitation of loudspeaker set-up, due to −30 . . . +30 degree position of loudspeakers. Thus it helps to create an immersive sound stage that surrounds a listener, rather than to provide the listener with a narrow sound stage limited by a 60-degree aperture angle. Furthermore, the rotation of the sound stage is of interest as it allows the user of the headphone reproduction system to hear the sound sources at fixed (stable and constant) positions independent of a user's head rotation.

In an embodiment, the perceived position r corresponding to the estimated desired position is modified to result in the modified perceived position expressed as:

$$r'=r+h,$$

whereby h is an offset corresponding to a rotation of the sound stage. The angular representation of the source position facilitates very easy integration of head movement, in particular an orientation of a listener's head, which is implemented by applying an offset to angles corresponding to the source positions such that sound sources have a stable and constant positions independent of the head orientation. As a result of such offset the following benefits are achieved: more out-of-head sound source localization, improved sound source localization accuracy, reduction in front/back confusions, more immersive and natural listening experience.

In an embodiment, the perceived position corresponding to the estimated desired position is modified to result in the modified perceived position r' expressed as:

$$r'=cr,$$

whereby c is a scale factor corresponding to a widening or narrowing of the sound stage. Using of scaling is a very simple and yet effective way to widen the sound stage.

In an embodiment, the perceived position corresponding to the estimated desired position is modified in response to user preferences. It can occur that one user may want a completely immersive experience with the sources positioned around the listener (e.g. a user being a member of the musicians band), while others may want to perceive the sound stage as coming from the front only (e.g. sitting in the audience and listening from a distance).

In an embodiment, the perceived position corresponding to the estimated desired position is modified in response to a head-tracker data.

In an embodiment, the input channel signal is decomposed into time/frequency tiles. Using of frequency bands is advantageous as multiple sound sources are handled in more targeted way resulting in a better sound imaging. Additional advantage of time segmentation is that a dominance of sound sources is usually time dependent, e.g. some sources may be quiet for some time and active again. Using time segments, in addition to frequency bands, gives even more control of the individual sources present in the input channel signals.

In an embodiment, synthesizing of a virtual source is performed using head-related transfer functions, or HRTFs (F. L. Wightman and D. J. Kistler. Headphone simulation of free-field listening. I. Stimulus synthesis. J. Acoust. Soc. Am., 85:858-867, 1989). The spatial synthesis step comprises generation of the common component S[k] as a virtual sound source at the desired sound source position r'[b] (the calculation in the frequency domain is assumed). Given the frequency-dependence of r'[b], this is performed for each frequency band independently. Thus, the output signal L'[k], R'[k] for frequency band b is given by:

$$L'[k]=H_L[k,r'[b]]S[k]+H_L[k,-\gamma]D_L[k]$$

$$R'[k]=H_R[k,r'[b]]S[k]+H_R[k,+\gamma]D_R[k]$$

with $H_L[k,\xi]$ the FFT index k of an HRTF for the left ear at spatial position $\xi$, and indices L and R address the left and right ear, respectively. The angle $\gamma$ represents the desired spatial position of the ambiance, which can for example be + and −90 degrees, and may be dependent on the head-tracking information as well. Preferably, the HRTFs are represented in parametric form, i.e., as a constant complex value for each ear within each frequency band b:

$$H_L[k\epsilon k_b,\xi]=p_l[b,\xi]\exp(-j\phi[b,\xi]/2)$$

$$H_R[k\epsilon k_b,\xi]=p_r[b,\xi]\exp(+j\phi[b,\xi]/2)$$

with $p_l[b]$ an average magnitude value of the left-ear HRTF in parameter band b, $p_r[b]$ an average magnitude value of the right-ear HRTF in parameter band b, and $\phi[b]$ an average phase difference between $p_l[b]$ and $p_l[b]$ in a frequency band b. Detailed description of HRTF processing in the parametric domain is known from Breebaart, J., Faller, C. "Spatial audio processing: MPEG Surround and other applications", Wiley, 2007.

Although, the above synthesis step has been explained for signals in the frequency domain, the synthesis can also take place in the time domain by convolution of Head-Related Impulse Responses. Finally, the frequency-domain output signals L'[k], R'[k] are converted to the time domain using e.g. inverse FFTs or inverse filterbank, and processed by overlap-add to result in the binaural output signals. Depending on the analysis window w[n], a corresponding synthesis window may be required.

In an embodiment, synthesis of a virtual source is performed for each frequency band independently. Using frequency bands is advantageous as multiple sound sources are handled in more targeted way resulting in a better sound imaging. Another advantage of the processing in bands is based on the observation that in many cases (for example when using Fourier-based transforms), the number of audio samples present in a band is smaller than the total number of audio samples in the input channel signals. As each band is processed independently of the other frequency bands, the total required processing power is lower.

Figure 2:
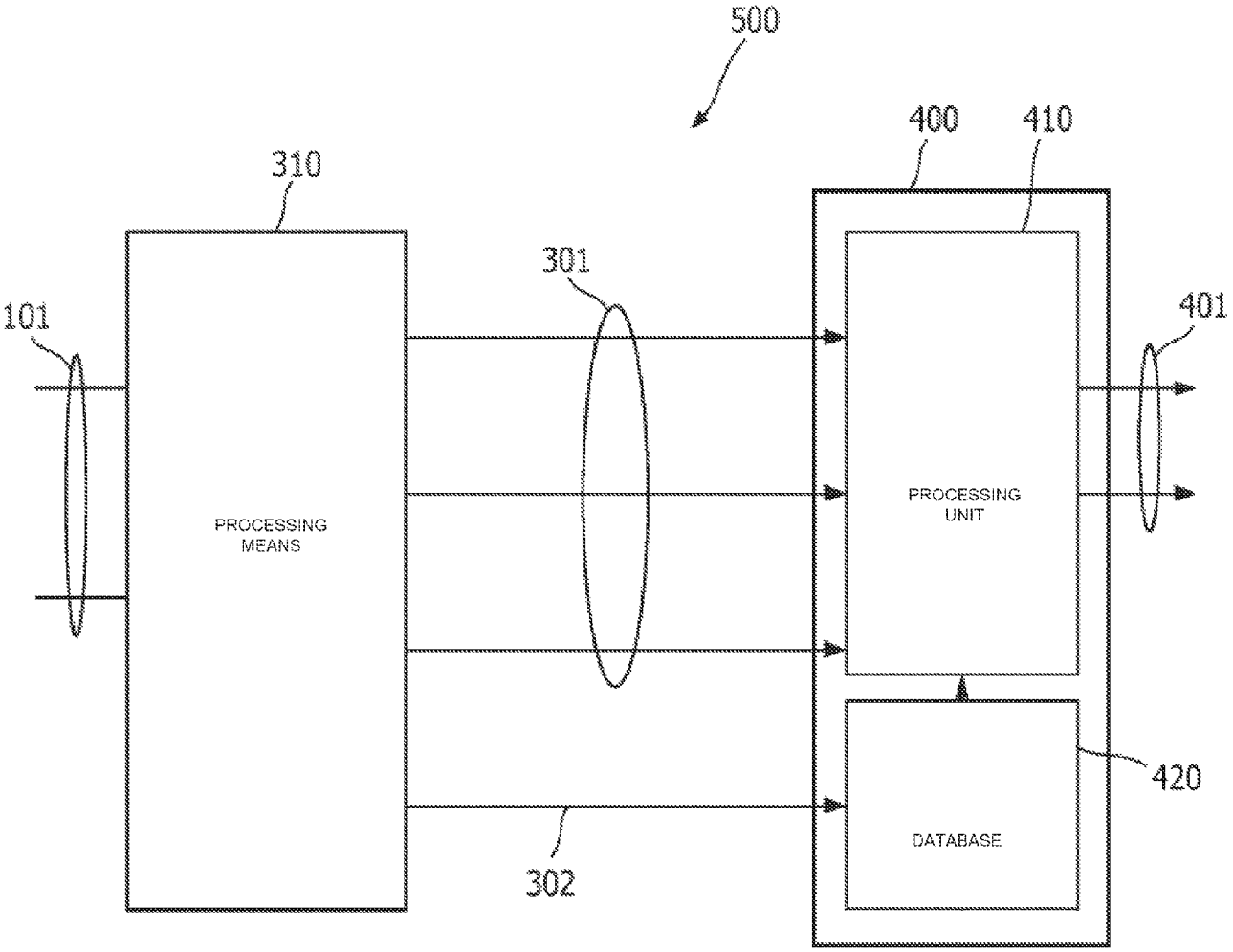
FIG. 2 schematically shows an example of a headphone reproduction system comprising a processing means for deriving the common component with the corresponding estimated desired position, and residual components, as well as a synthesizing means for synthesizing the main virtual source corresponding to the common component at the estimated desired position and further virtual sources corresponding to residual components at predetermined positions.

FIG. 2 schematically shows an example of a headphone reproduction system 500 comprising a processing means 310 for deriving the common component with the corresponding estimated desired position, and residual components, as well as a synthesizing means 400 for synthesizing the main virtual source corresponding to the common component at the estimated desired position and further virtual sources corresponding to residual components at predetermined positions.

The processing means 310 derive a common component for a pair of input channel signals from said at least two input channel signals 101 and an estimated desired position corresponding to said common component. Said common component is a common part of said pair of said at least two input channel signals 101. Said processing means 310 further derive a residual component for each of the input channel signals in said pair, whereby each of said residual components is derived from its corresponding input channel signal by subtracting a contribution of the common component. Said contribution is related to an estimated desired position. The derived common component, and residual components indicated by 301 and the estimated desired position indicated by 302 are communicated to the synthesizing means 400.

The synthesizing means 400 synthesizes, for each pair of input channel signals from said at least two input channel signals, a main virtual source comprising said common component at the estimated desired position, as well as two further virtual sources each comprising a respective one of said residual components at respective predetermined positions. Said synthesizing means comprise head-related transfer function (=HRTF) database 420, which based on the estimated desired position 302 provides an appropriate input by means of HRTFs corresponding to the estimated desired position and HRTFs for the predetermined positions to a processing unit 410 that applies HRTFs in order to produce binaural output from the common component, and residual components 301 obtained from the processing means 310.

Figure 3:
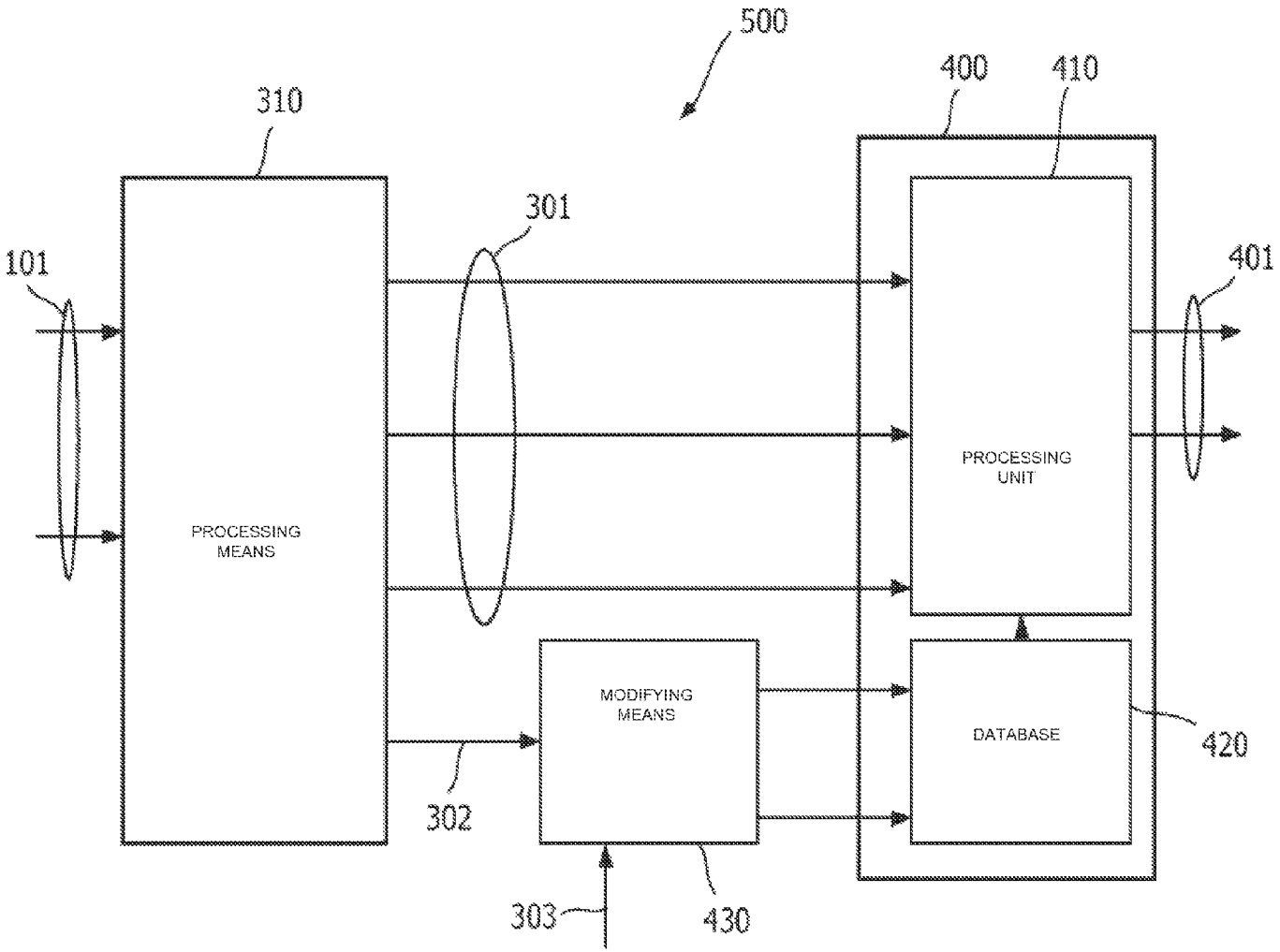
FIG. 3 shows an example of the headphone reproduction system further comprising a modifying means for modifying the perceived position corresponding to the estimated desired position, said modifying means operably coupled to said processing means and to said synthesizing means.

FIG. 3 shows an example of the headphone reproduction system further comprising a modifying means 430 for modifying the perceived position corresponding to the estimated desired position, said modifying means operably coupled to said processing means 310 and to said synthesizing means 400. Said means 430 receive the estimated desired position corresponding to the common component, as well as the input about desired modification. Said desired modification is for example related to a listener's position or its head position. Alternatively, said modification relates to the desired sound stage modification. The effect of said modifications is a rotation or widening (or narrowing) of the sound scene.

In an embodiment, the modifying means is operably coupled to a head-tracker to obtain a head-tracker data according to which the modification of the perceived position corresponding to the estimated desired position is performed. It enables the modifying means 430 to receive accurate data about the head movement and thus precise adaptation to said movement.

Figure 4:
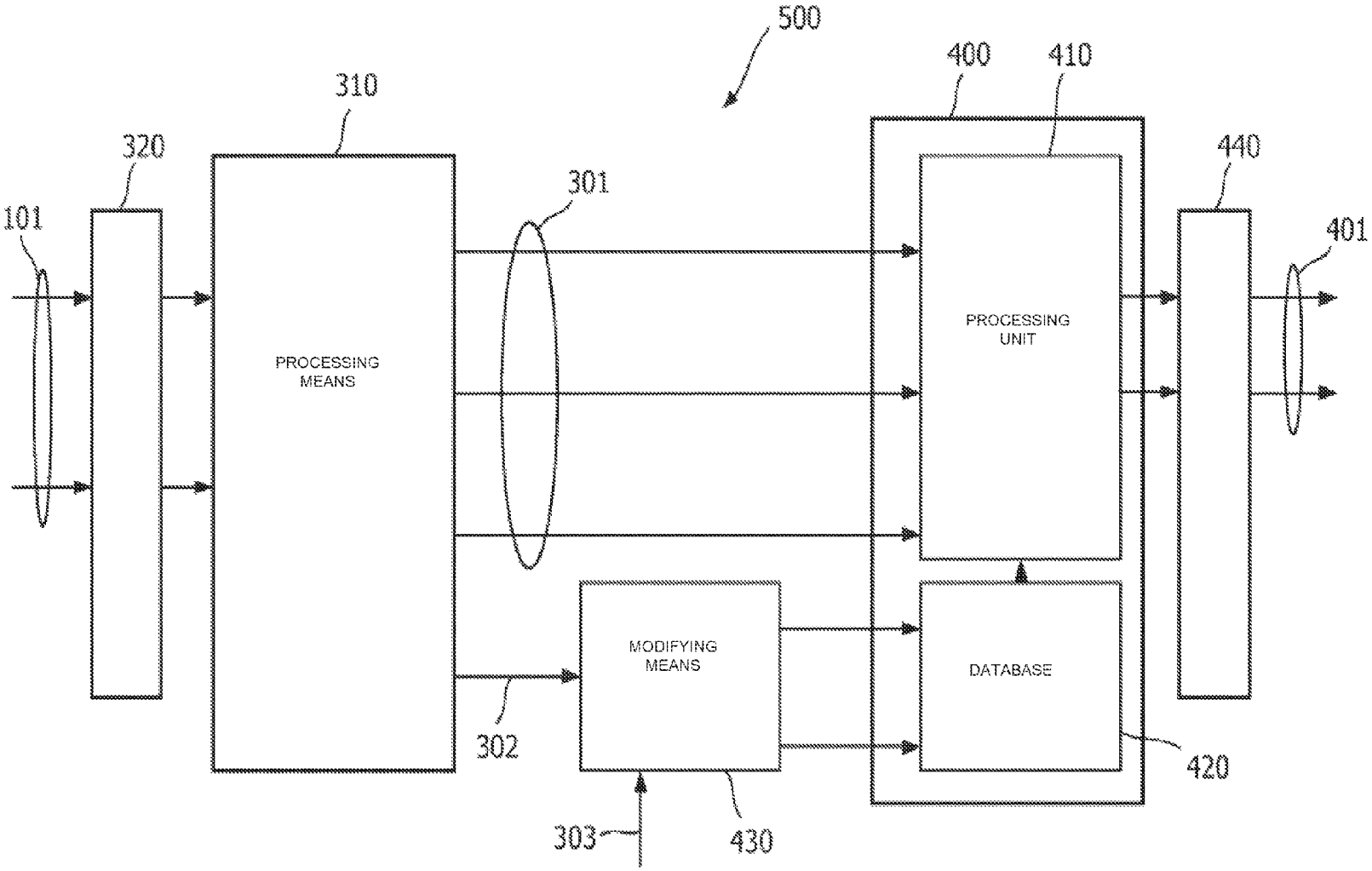
FIG. 4 shows an example of the headphone reproduction system for which the input channel signal is transformed into a frequency domain before being fed into the processing means and the output of synthesizing means is converted to a time domain by means of an inverse operation.
Figure 5E:
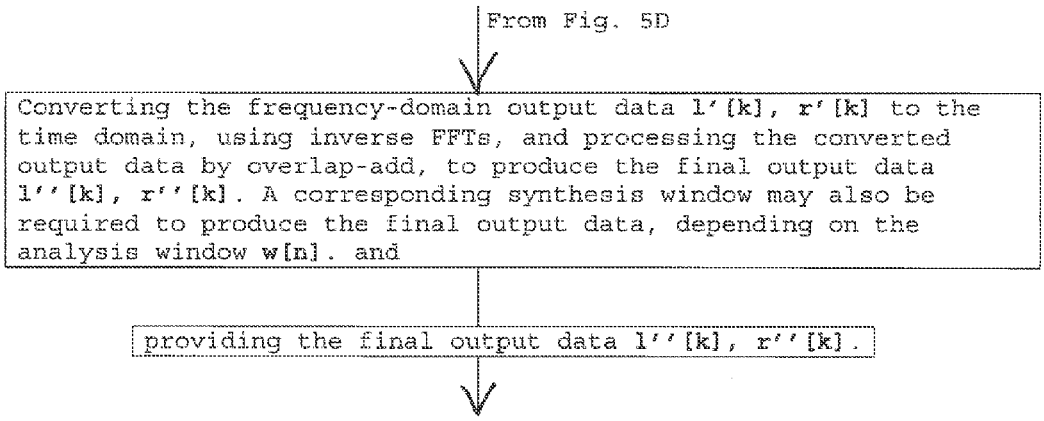

FIG. 4 shows an example of the headphone reproduction system for which the input channel signal is transformed into a frequency domain before being fed into the processing means 310 and the output of synthesizing means 400 is converted to a time domain by means of an inverse operation. The result of this is that synthesis of virtual sources is performed for each frequency band independently. The reproduction system as depicted in FIG. 3 is now extended by a unit 320 preceding the processing means 310, and a unit 440 succeeding the processing unit 400. Said unit 320 performs conversion of the input channel signal into the frequency domain. Said conversion is realized by use of e.g. filterbanks, or FFT. Other time/frequency transforms can also be used. The unit 440 performs the inverse operation to this performed by the unit 310.

It should be noted that the above-mentioned embodiments illustrate rather than limit the invention, and those skilled in the art will be able to design many alternative embodiments without departing from the scope of the appended claims. In the accompanying claims, any reference signs placed between parentheses shall not be construed as limiting the claim. The word "comprising" does not exclude the presence of elements or steps other than those listed in a claim. The word "a" or "an" preceding an element does not exclude the presence of a plurality of such elements. The invention can be implemented by means of hardware comprising several distinct elements, and by means of a suitably programmed computer.

The invention claimed is:

1. A method for headphone reproduction of at least two input channel signals, said method comprising for each pair of input channel signals from said at least two input channel signals:

determining a common component, an estimated desired position corresponding to said common component, and two residual components corresponding to two input channel signals in said pair of input channel signals, the determining being based on said pair of said input channel signals, whereby each of said residual components is derived from its corresponding input channel signal by subtracting a contribution of the common component, said contribution being related to the estimated desired position of the common component, synthesizing in the frequency or time domain a main virtual source comprising said common component at the estimated desired position, wherein said synthesized main virtual source is provided as a first output for use in a headphone reproduction system, synthesizing in the frequency or time domain two further virtual sources each comprising a respective one of said residual components at respective first and second predetermined positions, wherein said two further virtual sources are provided as respective second and third outputs for use in said headphone reproduction system, and wherein the estimated desired position represents a spatial position perceived by a user in the headphone reproduction system, the spatial position perceived to be between the two predetermined positions corresponding to said first and second predetermined positions in the headphone reproduction system, wherein the estimated desired position corresponding to the common component is determined depending on power parameters of the corresponding input channel signal, and wherein for a pair of input channel signals said power parameters comprise: a left channel power Pl, a right channel power Pr, and a cross-power Px.

2. A method as claimed in claim 1, wherein said contribution of the common component to input channel signals of said pair is expressed in terms of a cosine of the estimated desired position for the input channel signal perceived as left and a sine of the estimated desired position for the input channel perceived as right.

3. A method as claimed in claim 1, wherein the common component and the corresponding residual component are dependent on correlation between input channel signals for which said common component is determined.

4. A method as claimed in claim 1, wherein the estimated desired position corresponding to the common component is dependent on correlation between input channel signals for which said common component is determined.

5. A method as claimed in claim 1, wherein the estimated desired position υ corresponding to the common component is derived as:

$$\upsilon = \arctan\left(\frac{\sqrt{P_l}\cos(\alpha+\beta)}{\sqrt{P_r}\cos(-\alpha+\beta)}\right)$$

with $$\alpha = \frac{1}{2}\arccos\left(\frac{P_x}{\sqrt{P_l P_r}}\right),$$

$$\beta = \tan\left(\arctan(\alpha)\frac{\sqrt{P_r}-\sqrt{P_l}}{\sqrt{P_r}+\sqrt{P_l}}\right).$$

6. A method as claimed in claim 5, wherein the estimated desired position represents a spatial position between the two predetermined positions corresponding to two virtual speaker positions, wherein a range maps to a range υ=0 . . . 90maps to a range r=−30 . . . 30 degrees for the perceived position angle.

7. A method as claimed in claim 6, wherein the perceived position angle correspondingto the estimated desired position is derived according to:

$$r = \left(-\upsilon + \frac{\pi}{4}\right)\frac{2}{3}.$$

8. A method as claimed in claim 1, wherein power parameters are derived from the input channel signal converted to a frequency domain.

9. A method as claimed in claim 8, wherein the input channel signal is converted to the frequency domain using Fourier-based transform.

10. A method as claimed in claim 1, wherein the input channel signal is converted to the frequency domain using a filter bank.

11. A method as claimed in claim 1, wherein power parameters are derived from the input channel signal represented in a time domain.

12. A method as claimed in claim 1, wherein the perceived position r corresponding to the estimated desired position is modified to result in one of: narrowing, widening, or rotating of a sound stage.

13. A method as claimed in claim 12, wherein the perceived position r corresponding to the estimated desired position is modified to result in the modified perceived position expressed as:

$$r' = r + h,$$

wherein h is an offset corresponding to a rotation of the sound stage.

14. A method as claimed in claim 12, wherein the perceived position corresponding to the estimated desired position is modified to result in the modified perceived position r' expressed as:

$$r' = cr,$$

wherein c is a scale factor corresponding to a widening or narrowing of the sound stage.

15. A method as claimed in claim 12, wherein the perceived position corresponding to the estimated desired position is modified in response to user preferences.

16. A method as claimed in claim 12, wherein the perceived position corresponding to the estimated desired position is modified in response to a head-tracker data.

17. A method as claimed in claim 1, wherein the input channel signal is decomposed into time/frequency tiles.

18. A method as claimed in claim 1, wherein synthesizing of a virtual source is performed using head-related transfer functions.

19. A method as claimed in claim 18, wherein synthesis of a virtual source is performed for each frequency band independently.

20. A non-transitory computer readable medium encoded with a program having computer-executable instructions that when executed by a processor executes the method of claim 1.

21. A headphone reproduction system for reproduction of at least two input channel signals, said headphone reproduction system comprising:

a processing means for determining for each pair of input channel signals from said at least two input channels signals a common component, an estimated desired position corresponding to said common component, and two residual components corresponding to two input channel signals in said pair of input channel signals, said determining being based on said pair of said input channel signals, whereby each of said residual components is derived from its corresponding input channel signal by subtracting a contribution of the common component, said contribution being related to the estimated desired position of the common component; and a synthesizing means for synthesizing in the frequency or time domain a main virtual source comprising said common component at the estimated desired position, wherein said synthesized main virtual source is provided as a first output for use in a headphone reproduction system, and two further virtual sources each comprising a respective one of said residual components at respective predetermined positions, wherein said two further virtual sources are provided as respective second and third outputs for use in said headphone reproduction system, wherein the estimated desired position represents a spatial position perceived by a user in the headphone reproduction system, the spatial position perceived to be between the two predetermined positions corresponding to said first and second predetermined positions in the headphone reproduction system, wherein the estimated desired position corresponding to the common component is determined depending on power parameters of the corresponding input channel signal, and wherein for a pair of input channel signals said power parameters comprise: a left channel power Pl, a right channel power Pr, and a cross-power Px.

22. A headphone reproduction system as claimed in claim 21, wherein said headphone reproduction system further comprises a modifying means for modifying the perceived position corresponding to the estimated desired position, said modifying means operably coupled to said processing means and to said synthesizing means.

23. A headphone system as claimed in claim 22, wherein the modifying means is operably coupled to a head-tracker to obtain a head-tracker data according to which the modification of the perceived position corresponding to the estimated desired position is performed.

24. A headphone reproduction system as claimed in claim 21, wherein the input channel signal is transformed into a frequency domain before being fed into the processing means and the output of synthesizing means is converted to a time domain by means of an inverse operation.

25. A method for headphone reproduction of at least two input channel signals, said method comprising for each pair of input channel signals from said at least two input channel signals:

determining a common component, an estimated desired position corresponding to said common component, and two residual components corresponding to two input channel signals in said pair of input channel signals, the determining being based on said pair of said input channel signals, whereby each of said residual components is derived from its corresponding input channel signal by subtracting a contribution of the common component, said contribution being related to the estimated desired position of the common component; and synthesizing in the frequency or time domain a main virtual source comprising said common component at the estimated desired position, and synthesizing in the frequency or time domain two further virtual sources each comprising a respective one of said residual components at respective predetermined positions, wherein the estimated desired position corresponding to the common component is determined depending on power parameters of the corresponding input channel signal, wherein for a pair of input channel signals said power parameters comprise: a left channel power Pl, a right channel power Pr, and a cross-power Px, and wherein the estimated desired position υ corresponding to the common component is derived as:

$$\upsilon = \arctan\left(\frac{\sqrt{P_l}\cos(\alpha+\beta)}{\sqrt{P_r}\cos(-\alpha+\beta)}\right)$$

with $$\alpha = \frac{1}{2}\arccos\left(\frac{P_x}{\sqrt{P_l P_r}}\right),$$

$$\beta = \tan\left(\arctan(\alpha)\frac{\sqrt{P_r}-\sqrt{P_l}}{\sqrt{P_r}+\sqrt{P_l}}\right).$$

* * * * *